US011603753B2

(12) United States Patent
Parthasarathy et al.

(10) Patent No.: US 11,603,753 B2
(45) Date of Patent: Mar. 14, 2023

(54) AUTOMATED HIGH-PRESSURE PUMP TESTING SYSTEM

(71) Applicant: ADS Services, LLC, Midland, TX (US)

(72) Inventors: Anand Parthasarathy, Cypress, TX (US); Brian Ellis, Spring, TX (US)

(73) Assignee: ADS SERVICES, LLC, Midland, TX (US)

( * ) Notice: Subject to any disclaimer, the term of this patent is extended or adjusted under 35 U.S.C. 154(b) by 0 days.

(21) Appl. No.: 17/460,124

(22) Filed: Aug. 27, 2021

(65) Prior Publication Data

US 2022/0213781 A1 Jul. 7, 2022

Related U.S. Application Data

(60) Provisional application No. 63/070,998, filed on Aug. 27, 2020.

(51) Int. Cl.

| | |
|---|---|
| ***E21B 34/02*** | (2006.01) |
| ***E21B 43/26*** | (2006.01) |
| ***E21B 47/008*** | (2012.01) |
| ***E21B 47/06*** | (2012.01) |
| ***G08B 21/18*** | (2006.01) |

(52) U.S. Cl.

CPC ..... *E21B 47/008* (2020.05); *E21B 34/025* (2020.05); *E21B 43/2607* (2020.05); *E21B 47/06* (2013.01); *G08B 21/18* (2013.01)

(58) Field of Classification Search

CPC ..... E21B 34/02; E21B 34/025; E21B 43/26; E21B 43/2607; E21B 47/008; E21B 47/06

See application file for complete search history.

(56) References Cited

U.S. PATENT DOCUMENTS

2019/0292901 A1* 9/2019 Islam ..... E21B 47/06
2021/0063271 A1* 3/2021 Mazrooee ..... G01M 3/2892

* cited by examiner

*Primary Examiner* — Matthew R Buck

(57) ABSTRACT

A system for automated testing of a high-pressure pump comprises a choke valve, actuator and actuator drive for operating the choke in response to receiving control signals. A system control unit includes a processor unit, system memory, I/O interface, human-machine interface, and display device. A pressure sensor is connected to the pump outlet line for sensing and reporting outlet pressure to the control unit. The control unit can execute a test phase by causing the pump to run at a test speed and causing the actuator to change the restriction value of the choke until a predetermined pressure is sensed in the outlet line and reported to the control unit. The control unit can cause the actuator to maintain the predetermined pressure for a predetermined period of time. The control unit can cause the display device to show a result or print a report of one or more test phases.

9 Claims, 4 Drawing Sheets

AUTOMATED HIGH-PRESSURE PUMP TESTING SYSTEM

CROSS-REFERENCE TO RELATED APPLICATIONS

This application claims benefit of U.S. Provisional Application No. 63/070,998, filed Aug. 27, 2020, entitled SYSTEM AND METHOD FOR CHOKE VALVE OPERATION IN HIGH PRESSURE FRACKING SYSTEMS, the specification of which is incorporated by reference herein in its entirety.

TECHNICAL FIELD

This disclosure relates to apparatus and systems for automated testing of high-pressure pumps. In one application, the system can test high pressure fluid pumps used in hydraulic fracturing (i.e., fracking). In some embodiments, the system can automatically test the operation of a high-pressure pump to produce and maintain each in a series of predetermined pressures.

BACKGROUND

Pumps used for the oil and gas industry, such as fracking pumps, triplex mud pumps, etc., are operated at a high pressure to send fluid downstream a well bore for applications such as fracking and drilling. The manufacturers of said pumps perform factory acceptance tests to ensure that the pumps can generate high pressures for longer intervals which may be needed for particular operations. These high pressures can be 4,000 psi, 6,000 psi, 8,000 psi, and as high as 11,000-12,000 psi. The current practice is to use a choke valve (i.e., a "choke") downstream of the pump to create the needed high pressures. However, the choke valves are operated manually by means of a user adjusting the choke movement to result in needed pressure build up. There are several limitations to this set-up. For example, manual adjustment of the choke valve is slower than automated processes and risks the introduction of user error during operation. Further, at higher pressure requirements, the choke valve may operate in a sensitive area of the choke valve's flow coefficient (Cv) curve, thereby making precise pressure control using the choke valve difficult and resulting in frequent overshoot and/or undershoot of desired pressure values or ranges. In some cases, managed pressure drilling (MPD) systems may be used for pressure set point control, however, these MPD systems have only been used and/or proven for lower pressure operations with a max pressure of around 1,000 to 1,500 psi.

SUMMARY

In one aspect, a fracking system comprises a pump in fluid communication with a wellbore via a fluid supply line and a choke valve system. The choke valve system comprises a choke valve in fluid communication with the wellbore via a fluid return line and configured to receive a return fluid from the wellbore, the choke valve selectively positionable in a fully shut position, a fully open position, and a range of intermediate positions between the fully shut position and the fully open position. The choke valve system further comprises a motor connected to the choke valve with a worm gear and configured to selectively position the choke valve, the motor and the worm gear having a total gear ratio greater than or equal to 100.

In one embodiment, the motor and the worm gear have a total gear ratio greater than or equal to 300.

In another embodiment, the fracking system further comprises a controller in communication with the motor and configured to control one or both of a torque or a speed of the motor based on an intermediate position of the choke valve.

In still another embodiment, the controller causes the motor to apply a first torque with the choke valve between a first intermediate position and the fully open position and a second torque with the choke valve between the first intermediate position and a second intermediate position, wherein the second torque is greater than the first torque.

In yet another embodiment, the controller causes the motor to apply a third torque with the choke valve between the second intermediate position and the fully shut position, wherein the third torque is less than the second torque.

In a further embodiment, the first intermediate position corresponds to a position of the choke valve of about thirty percent open and the second intermediate position corresponds to a position of the choke valve of about 10 percent open.

In a still further embodiment, the controller causes the motor to operate at a first speed with the choke valve between the first intermediate position and the fully open position and a second speed with the choke valve between the first intermediate position and the fully shut position, wherein the second speed is less than the first speed.

In a yet further embodiment, the controller is configured to selectively position the choke valve based on a magnitude of a control error function.

In another embodiment, the control error function is based on a percentage difference between a current pressure of the return fluid and a desired hold pressure of the return fluid.

In another aspect, a method for controlling a choke valve of a fracking system comprises supplying a fluid to a wellbore with a pump via a fluid supply line. The method further comprise receiving fluid from the wellbore with a choke valve via a fluid return line, the choke valve being selectively positionable in a fully shut position, a fully open position, and a range of intermediate positions between the fully shut position and the fully open position. The method further comprises controlling the choke valve with a motor connected to the choke valve with a worm gear by applying a first torque with the choke valve between a first intermediate position and the fully open position and a second torque with the choke valve between the first intermediate position and a second intermediate position, wherein the second torque is greater than the first torque.

In one embodiment, controlling the choke valve further comprises applying a third torque with the choke valve between the second intermediate position and the fully shut position, wherein the third torque is less than the second torque.

In another embodiment, the first intermediate position corresponds to a position of the choke valve of about thirty percent open and the second intermediate position corresponds to a position of the choke valve of about 10 percent open.

In still another embodiment, controlling the choke valve further comprises operating the motor at a first speed with the choke valve between the first intermediate position and the fully open position and a second speed with the choke valve between the first intermediate position and the fully shut position, wherein the second speed is less than the first speed.

In yet another embodiment, controlling the choke valve further comprises selectively positioning the choke valve based on a magnitude of a control error function.

In a further embodiment, the control error function is based on a percentage difference between a current pressure of the fluid and a desired hold pressure of the fluid.

In a still further embodiment, controlling the choke valve further comprises determining that movement of the choke valve has stopped while operating the motor to selectively position the choke valve, with the choke valve between the second intermediate position and the fully open position; stopping the motor in response to determining that movement of the choke valve has stopped; and producing an error message.

In yet a further embodiment, the method further comprises determining that a pressure of the fluid is greater than a threshold safety pressure, and stopping the motor in response to determining that the pressure of the fluid is greater than the threshold safety pressure.

In yet another aspect, a system for automated testing of a high-pressure pump is provided, the high-pressure pump having a pump outlet line for carrying high-pressure fluid. The system comprises a choke valve defining a choke passage therethrough having an inlet at one end, an outlet at the other end and a gate positioned therebetween, wherein the gate is selectively movable along a path to change a fluid restriction value of the choke passage. The inlet of the choke is connectable to a pump outlet line of a high-pressure pump to be tested. A choke actuator has an input shaft and is operatively connected to the gate of the choke valve for moving the gate along the path in response to rotation of the input shaft. An actuator drive is operatively connected to the input shaft of the actuator for selectively rotating the input shaft in response to receiving actuator drive control signals. A system control unit includes a processor unit for executing program steps, a system memory for storing program steps and data, an input/output (I/O) interface for communicating between the processor unit and system memory, a human-machine interface (HMI) for accepting control inputs from a human user, and a display device for communicating at least one of a system status and a test result to the human user. A pressure sensor is connected to the pump outlet line for sensing the pressure of a fluid in the pump outlet line and communicating pump output pressure signals indicative of the fluid pressure within the pump outlet line to the system control unit. The system control unit can execute a first test phase by causing the pump to run at a first speed and causing the actuator drive to rotate the input shaft of the actuator to cause the actuator to move the gate of the choke valve to change the fluid restriction value of the choke path until a first predetermined pressure is sensed in the high-pressure line by the pressure sensor and reported to the system control unit via pump output pressure signals. The system control unit can further cause the actuator drive to rotate the input shaft of the actuator to cause the actuator to move the gate of the choke valve to change the fluid restriction of the choke path to maintain the first predetermined pressure for a first predetermined period of time. The system control unit can cause the display device to show a result of the first test phase or print a report showing the result of the first test phase.

In one embodiment, after executing a first test phase, the system control unit can execute a subsequent test phase by causing the pump to run at a subsequent speed and causing the actuator drive to rotate the input shaft of the actuator to cause the actuator to move the gate of the choke valve to change the fluid restriction value of the choke path until a subsequent predetermined pressure is sensed in the high-pressure line by the pressure sensor and reported to the system control unit via pump output pressure signals, causing the actuator drive to rotate the input shaft of the actuator to cause the actuator to move the gate of the choke valve to change the fluid restriction of the choke path to maintain the subsequent predetermined pressure for a subsequent predetermined period of time, and causing the display device to show a result of the subsequent test phase or print a report showing the result of the subsequent test phase.

In another embodiment, stored instructions in the system memory are executed by the system control unit to cause: while the actuator is commanded to move the choke gate to achieve to a new predetermined pressure, the system control unit monitors at least one of choke position signal and choke actuator speed signal; and when the system control unit detects, before the new predetermined pressure is attained, that either the monitored choke position signal has stopped changing or the monitored actuator speed signal is unexpectedly low, the system control unit stops any further movement of the choke gate and sends out an error message to the display device, whereby debris in the choke passage are detected during a test.

BRIEF DESCRIPTION OF THE DRAWINGS

For a more complete understanding, reference is now made to the following description taken in conjunction with the accompanying Drawings in which.

DETAILED DESCRIPTION

Figure 1:
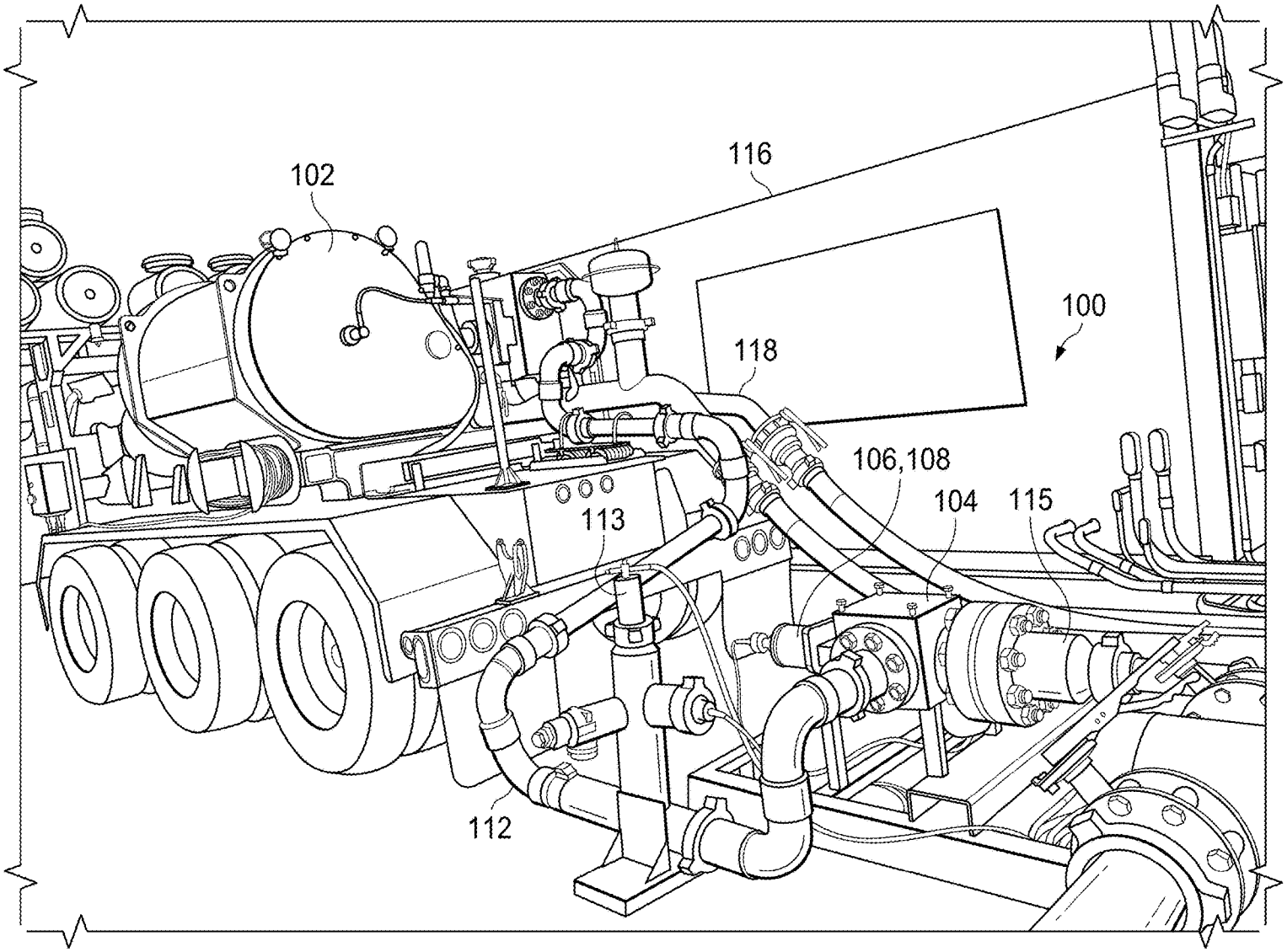
FIG. 1 shows an automated high-pressure pump testing system rigged up for testing a high-pressure pump.

According to an aspect of the present disclosure, a choke valve system and method for operation is provided which incorporates hardware as well as improved control algorithms to solve the current problem associated with high pressure fracking and drilling operations. This introduction of hardware and control algorithms is a novel approach to accurately holding high-pressure output of pumps which may be more than 10 times greater than typical pressure hold requirements (e.g., 10,000 to 12,000 psi).

Operation of the choke valve during high-pressure operation may include increased torque and resolution at low speeds in some or all choke valve positions between a fully shut position and a fully open position, and especially at lower choke valve positions (e.g., the sensitive Cv area of the choke valve less than about thirty percent (30%) open) to be able to move slowly & trap the greater than 10,000 psi well fluid with automatic control. In various embodiments, this application may, therefore, include operation of the choke valve with a motor (e.g., an electric or hydraulic motor) and worm gear having a high gear ratio of the order of greater than 100 or, in various embodiments, greater than 300, where the motor torque is multiplied by that ratio. In various embodiments, the motor and choke valve may have a total gear ratio as high as 360 or higher, thereby providing more torque and resolution for this high-pressure pump control application.

In various embodiments, the choke valve system may include a controller configured to selectively position the choke valve in a fully shut position, a fully open position, and a range of intermediate positions between the fully shut position and the fully open position, as well as to control a torque and/or a speed of the motor. In various embodiments, the controller may be further configured to implement an algorithm which increases motor torque and/or reduces motor speed during choke valve travel in the sensitive Cv area of choke valve less than or equal to about thirty percent (30%) open. In various embodiments, the algorithm my further limit the motor torque when the choke valve is closing, thereby preventing damage to the choke trim. High torque values generated by an electric or hydraulic motor during operation of the choke valve may cause the choke valve gate to close against the choke valve seat, thereby damaging the internals of the choke valve. Accordingly, implementation of the algorithm by the controller may cause the controller to limit the motor torque at a choke valve position less than or equal to about ten percent (10%) open, when the choke valve is close to closing. The motor torque, limited in such a way, may also permit the user to be able to close the choke with no pressure within the choke valve so that the user is able to perform gate to seat tests to get a full seal as part of API pressure test requirement, hence not comprising that functionality.

Since the motor torque may be limited only from about ten percent (10%) to zero percent (0%, e.g., fully shut) choke open, in various embodiments another safety feature of the algorithm may be provided because of this relatively higher torque available between one hundred percent (100%, e.g., fully open) and ten percent (10%) choke open. In the event that debris is stuck within the choke valve at any point between one hundred percent (100%, e.g., fully open) and ten percent (10%) choke open, the gate of the choke valve may contact the debris which may, in turn, rub against or otherwise contact the seat of the choke valve, thereby mimicking a choke closed condition. Since the torque is not limited to the reduced torque values corresponding to the choke valve position below ten percent (10%) choke open, said debris can again damage the choke valve internals as a result of the higher motor torque. Hence, according to aspects of the present disclosure, if the algorithm detects the choke valve movement has stopped when trying to travel to trap higher pressure set point, the algorithm will immediately stop any further choke movement and will send out an error message for a user to perform an inspection or maintenance on the choke valve system. Additionally, in various embodiments, if the algorithm detects an increase in well bore fluid pressure greater than a safety threshold, the algorithm will immediately stop any further choke valve movement. For example, the algorithm may stop choke valve movement in response to user control of the choke valve which exceeds the safety threshold, thereby preventing damage to the choke valve, the fracking system, and/or the well.

In various embodiments, the controller may selectively position the choke valve based on a magnitude of a control error function. In conventional choke valve systems, control of the choke valve may be based on a control error function which is calculated based on a difference between a current pressure and a set point pressure of the well fluid. In high-pressure applications, this determination of control error may be ineffective as the difference between the current and the set point pressure can be as very high (e.g., 10,000-12,000 psi). As a result, the conventional auto control algorithm may determine the choke valve has a longer distance to travel in order to cause the well fluid to reach the needed set point pressure. In this case, the choke valve may move rapidly to traverse the determined longer distance, thereby overshooting and causing a relief valve in the choke valve line to lift, reducing well fluid pressure to 0 psi and causing operational down time.

Hence, in high pressure applications, aspects of the present disclosure provide an algorithm for auto choke control to hold backpressure which includes calculating a percentage difference between a current well fluid pressure to required pressure to hold rather than by a magnitude of pressure difference between the current well fluid pressure and the set point pressure. This implementation of the algorithm results in an error margin having a manageably smaller control error function in a form of a percentage value instead of a relatively large value associated with the magnitude of pressure difference between the currently well fluid pressure and the set point pressure. For example, the error margin may be represented by a difference between the set point pressure and the current well fluid pressure expressed as a percentage of the set point pressure.

The above-discussed hardware changes and improved algorithm-based choke valve control, alone or in combination, may provide automatic choke control of pumps in high-pressure fracking and drilling operations. Aspects of the present disclosure may be applicable for any pump operation (fracking, drilling etc.) as well as for manufacturers as part of pump factory acceptability testing.

Referring now to FIG. 1, there is illustrated an automated high-pressure pump testing system 100 in accordance with one embodiment rigged up for testing a high-pressure pump 102. The test system 100 comprises a choke valve 104 fitted with a choke actuator 106 having an actuator drive 108. In some embodiments, the choke valve 104 defines a choke passage therethrough having an inlet at one end, an outlet at the other end at a gate positioned therebetween, wherein the gate is selectively movable along a path to change the fluid restriction value of the choke passage. The inlet of the choke 104 is connectable to a pump outlet line 112 of the pump 102 to be tested. In some embodiments, the choke actuator 106 has an input shaft and is operatively connected to the gate of the choke valve 104 for moving the gate along the path of the choke passage in response to rotation of the input shaft. In some embodiments, the actuator drive 108 is operatively connected to the input shaft of the actuator 106 for selectively rotating the input shaft in response to receiving actuator drive control signals.

The system 100 further includes a system control unit 110 (FIG. 2) operably connected to the actuator drive 108 to send actuator drive control signals to the actuator drive. The pump 102 to be tested can be fluidly connected to the test system 100 using a high-pressure fluid line 112, which leaves the pump discharge and is connected to the inlet of the choke 104. A pressure sensor 113 is provided on the high-pressure line 112 and operatively connected to the system control unit 110 to provide pump output pressure signals 114 indicative of the pressure within the high-pressure line. A flow sensor 122 (FIG. 2) can be provided on the high-pressure line 112 and operatively connected to the system control unit 110 to provide pump output flow signals 124 indicative of the rate of fluid flow within the high-pressure line. A low-pressure fluid line 115, which is connected to the outlet of the choke 104, can connect to a fluid storage tank 116. Fluid from a fluid source can be supplied to the intake of the pump 104 via fluid intake line 118. Preferably, the fluid source for the pump 104 is also the fluid storage tank 116 so that the test fluid can be recirculated through the tank, pump and choke during testing. In some embodiments, the fluid storage tank 116 may include a chiller unit 120 (FIG. 2) to remove heat from the test fluid that can build up during pump testing.

Figure 2:
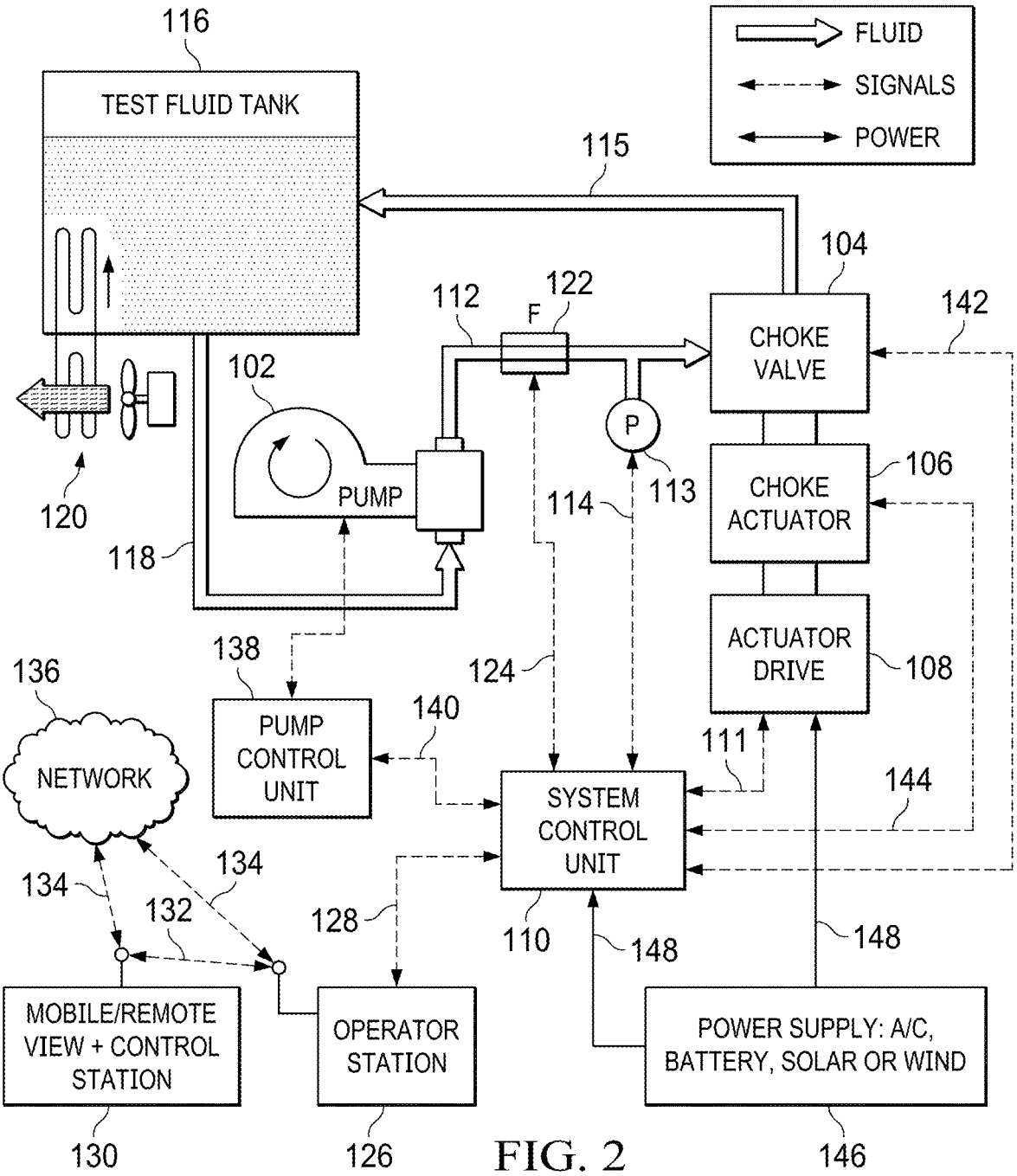
FIG. 2 shows a schematic diagram of an automated high-pressure pump testing system in accordance with another embodiment.

Referring now also to FIG. 2, there is shown a schematic diagram of an automated high-pressure pump testing system 100 illustrating additional aspects. The system control unit 110 can include a processor unit for executing program steps, a system memory for storing program steps and data, an input/output (I/O) interface for communicating between the processor unit, system memory, other elements of the system and external equipment, a human-machine interface (HMI) for accepting control inputs from a human user, and a display device for communicating system status and results to the human user. In some embodiments, the HMI for the system control unit 110 can be a keyboard, a button, a touchscreen, a joystick, a voice sensor and/or other apparatus for receiving human inputs and converting such inputs into machine-readable signals. In some embodiments, the display device can be a display screen, an indicator light, a speaker, a buzzer or other audio indicator, a printer and/or other apparatus for receiving machine-readable signals and converting such signals into human-readable information. The human-readable information can be transient information including, but not limited to, an active screen display, audio speech or sound, recorded information including, but not limited to, a video or data recording, and/or a permanent information including, but not limited to, a paper printout or a test report, all of the aforementioned indicating a least one of a status of the testing system 100 or a pump test result.

For safety reasons, it is preferable for a human operator to remain at a safe distance from the high-pressure pump 102 during testing. Therefore, in some embodiments of the automated test system 100, the HMI and display device for the system control unit 110 can be disposed at the same location as the processor unit, system memory and other components of the control unit; however, in other embodiments, the HMI and display device may be located and/or duplicated at a second location remote from the pump 102 and from the processor unit and system memory. Accordingly, in some embodiments, the automated test system 100 further includes an operator station 126 including a HMI and display device operatively connected to the system control unit 110 with remote control lines 128. Put another way, in some embodiments, the HMI and display device located at the operator station 126 will be the only HMI and display device for system 100, whereas in other embodiments, the HMI and display device located at the operator station 126 will duplicate another HMI and/or another display device located at the system control unit 110. The remote control lines 128 can be physical cables such as conventional multiple conductor wires, data communication cables such as Ethernet cables or local wireless communication links allowing data and/or control signals to be transferred between the system control unit 110 and the operator station 126.

In some embodiments, the automated test system 100 further comprises a mobile station 130 that is wirelessly connected to the system control unit 110 and/or to the operator station 126. In some embodiments, the mobile station 130 can be a dedicated apparatus duplicating the HMI and display device of the system control unit 110. In other embodiments, the mobile station 130 can be a conventional mobile device such as a mobile phone, tablet, laptop or computer executing a program allowing the mobile device to emulate all or parts of the HMI and display device of the system control unit 110. In some embodiments, the mobile station 130 can communicate data and control signals with the operator station 126 and/or system control unit 110 using a dedicated wireless link 132, for example a dedicated radio control link. In other embodiments, the mobile station 130 can communicate data and control signals with the operator station 126 and/or system control unit 110 by a networked wireless link 134 carried by a public or private network 136 including, but not limited to, the internet. For purposes of illustration, in FIG. 2 the mobile station 130 is only connected to the operator station 126, and is shown using both a dedicated link 132 and a networked link 134, whereas only one type of link would typically be used.

Referring still to FIG. 2, the high-pressure pump 102 can be controlled by a pump control unit 138, which is typically part of the conventional pump system. In some embodiments, the system control unit 110 is operatively connected to the pump control unit 138 to communicate pump control signal signals 140 to allow the automated testing system 100 to control the operation of the pump 102 during a test. In other embodiments, the system control unit 110 can be operatively connected directly to the pump 102 (i.e., bypassing any pump control unit 138) to allow the automated testing system 100 to communicate pump control signals 140 to the pump 102 to directly control the operation of the pump during the test. The system control unit 110 can further be operatively connected to the choke 104 to receive gate position signals 142 indicative of the position of the gate of the choke relative to the seat (e.g., an indication of choke percentage open). The system control unit 110 can further be operatively connected to the choke actuator 106 to receive actuator speed and/or revolution count signals 144 indicative of the movement speed of the actuator and/or of the cumulative travel of the actuator which can also indicate speed and/or cumulative travel of the choke gate.

Referring still to FIG. 2, the system control unit 100 can further comprise a power supply unit 146 that is operatively connected via electrical lines 148 to the system control unit 110 and the actuator drive 108 for providing electrical power. In some embodiments, the power supply unit 146 can receive input power from alternating current (AC) mains or from a fuel-powered generator. In some embodiments, the power supply unit 146 can receive input power from batteries and/or solar (photovoltaic) cells and/or from a wind-powered generator.

In some embodiments, the automated test system 100 can automatically implement the testing of a high-pressure pump 102 using the processor unit to execute stored instructions on the system memory. The system anticipates that the inlet of the pump 102 is connected to a source of test fluid, e.g., tank 116, and that the outlet of the pump is connected to the inlet of the choke 104. When executing the stored instructions, the system control unit 110 can execute a first test phase by commanding the pump control unit 138 to drive the pump 102 at a first speed and commanding the actuator drive 108 to move the choke gate until a first predetermined pressure can be sensed in the high-pressure line 112 by the pressure sensor 113 and reported via pressure signals 114. Optionally, the first associated fluid flow rate in the high-pressure line 112 can be sensed by the flow sensor 122 and reported to the system control unit 110 via pump flow signals 124. Optionally, the first associated speed and revolution of the choke actuator 106 can be sensed and reported to the system control unit 110 via the actuator speed signals 144. Optionally, the first associated gate position (e.g., percentage open) of the choke 104 can be sensed and reported to the system control unit 110 via the gate position signals 142. Optionally, the system control unit 110 can command the pump control unit 138 (and thus the pump 102) and choke actuator 108 to maintain the first predetermined pressure in the high-pressure line 112 for a first predetermined period of time. During the first phase pump test, the system control unit 110 can display the real-time parameters reported by the various sensors and actuators on the display device of the system control unit, operator station 126 and/or mobile station 130. Optionally, the system 100 may cause the display device to record the system parameters in real-time or print a report showing the results of the test.

After the automated testing system 100 completes the first test phase, the processor unit may optionally continue executing stored instructions to execute a second test phase. The system control unit 110 can command the pump control unit 138 to change the speed of the pump 102 to a second speed and/or command the actuator drive 108 to move the choke gate until a second predetermined pressure can be sensed in the high-pressure line 112 by the pressure sensor 113 and reported via pressure signals 114. The second predetermined pressure can be a higher pressure that the first predetermined pressure in order to incrementally test the safety and performance of the pump 102. Optionally, the second associated fluid flow rate in the high-pressure line 112 can be sensed by the flow sensor 122 and reported to the system control unit 110 via pump flow signals 124. Optionally, the second associated speed and revolution of the choke actuator 106 can be sensed and reported to the system control unit 110 via the actuator speed signals 144. Optionally, the second associated gate position of the choke 104 can be sensed and reported to the system control unit 110 via the gate position signals 142. Optionally, the system control unit 110 can command the pump control unit 138 and choke actuator 108 to maintain the second predetermined pressure in the high-pressure line 112 for a second predetermined period of time. During the second phase pump test, the system control unit 110 can continue to display the real-time parameters reported by the various sensors and actuators on the display device of the system control unit, operator station 126 and/or mobile station 130. Optionally, the system 100 may cause the display device to continue recording the system parameters in real-time or print a report showing the results of the test.

After the automated testing system 100 completes the second test phase, the processor unit may optionally continue executing stored instructions to execute a further successive test phases. In some embodiments, for each successive test phase, the new predetermined pressure can be a higher pressure that the previous first predetermined pressure in order to continually incrementally test the safety and performance of the pump 102 until the maximum pressure required for acceptance of the pump is successfully achieved. In other embodiments, the predetermined pressure of the second and subsequent test phases can be any desired pressures, regardless of whether they are successively increasing.

Figure 3:
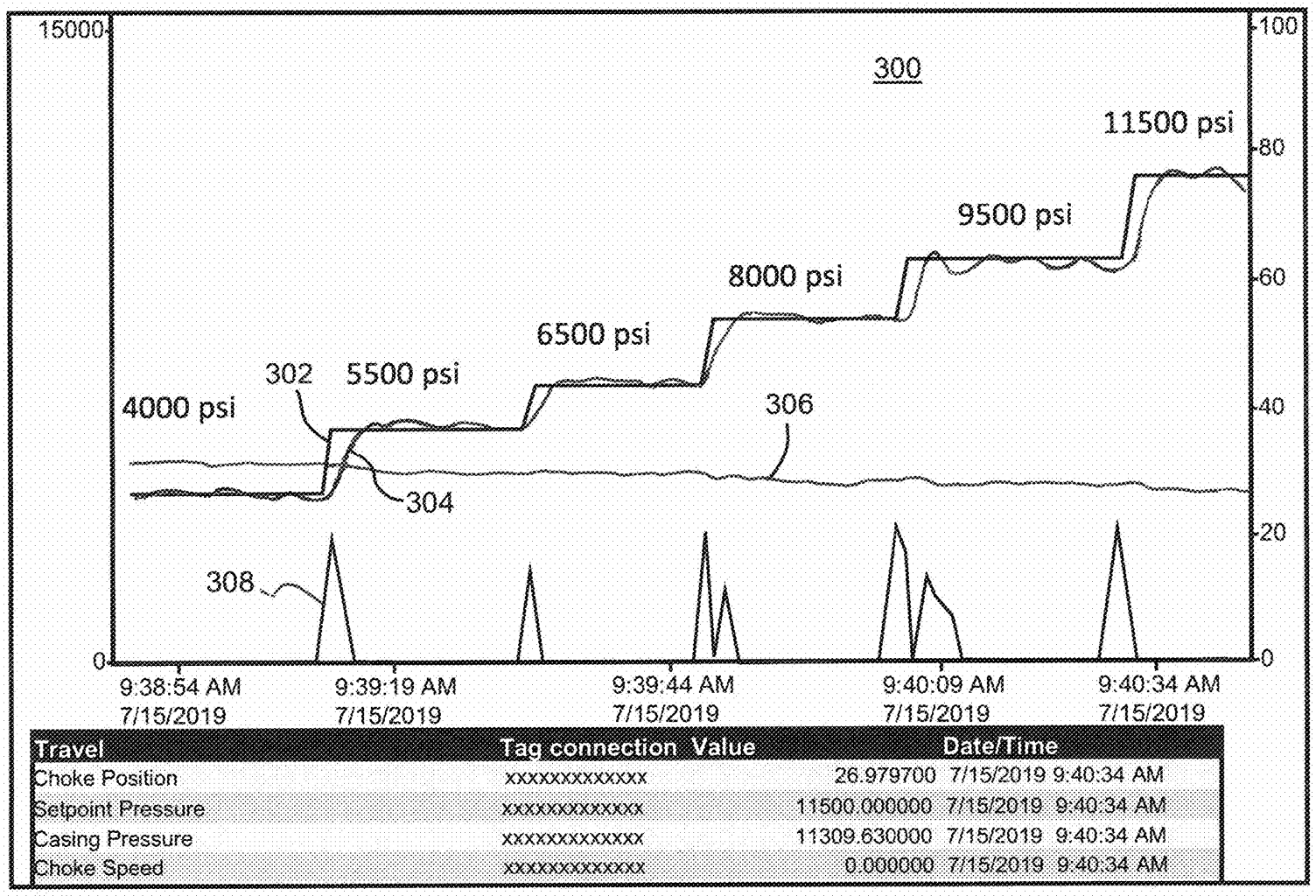
FIG. 3 shows a printed result of a test conducted by an automated high-pressure pump testing system in accordance with another embodiment, in this case a 4000, 5500, 6500, 8000, 9500, 11500 psi auto pressure hold test.

FIG. 3 shows a printed result 300 of a high-pressure pump test conducted by an automated high-pressure pump testing system in accordance with another embodiment, in this case a 4000, 5500, 6500, 8000, 9500, 11500 psi auto pressure hold test. Thus, this test included six successive test phases. In the report 300, the pressure setpoint (termed "Setpoint Pressure") commanded by the automated testing system 100 (i.e., the predetermined pressure) is shown by line 302 and the actual pressure (termed "Casing Pressure") measured by the system (e.g., by the pressure sensor 113) is shown by line 304. The associated actuator movement (termed "Choke Position") measured by the system 100 (e.g., by the actuator drive 108) is shown by line 306. The associated actuator speed (termed "Choke Speed") and duration, measured by the system 100 (e.g., from the actuator speed signals 144) is shown by line 308.

Figure 4:
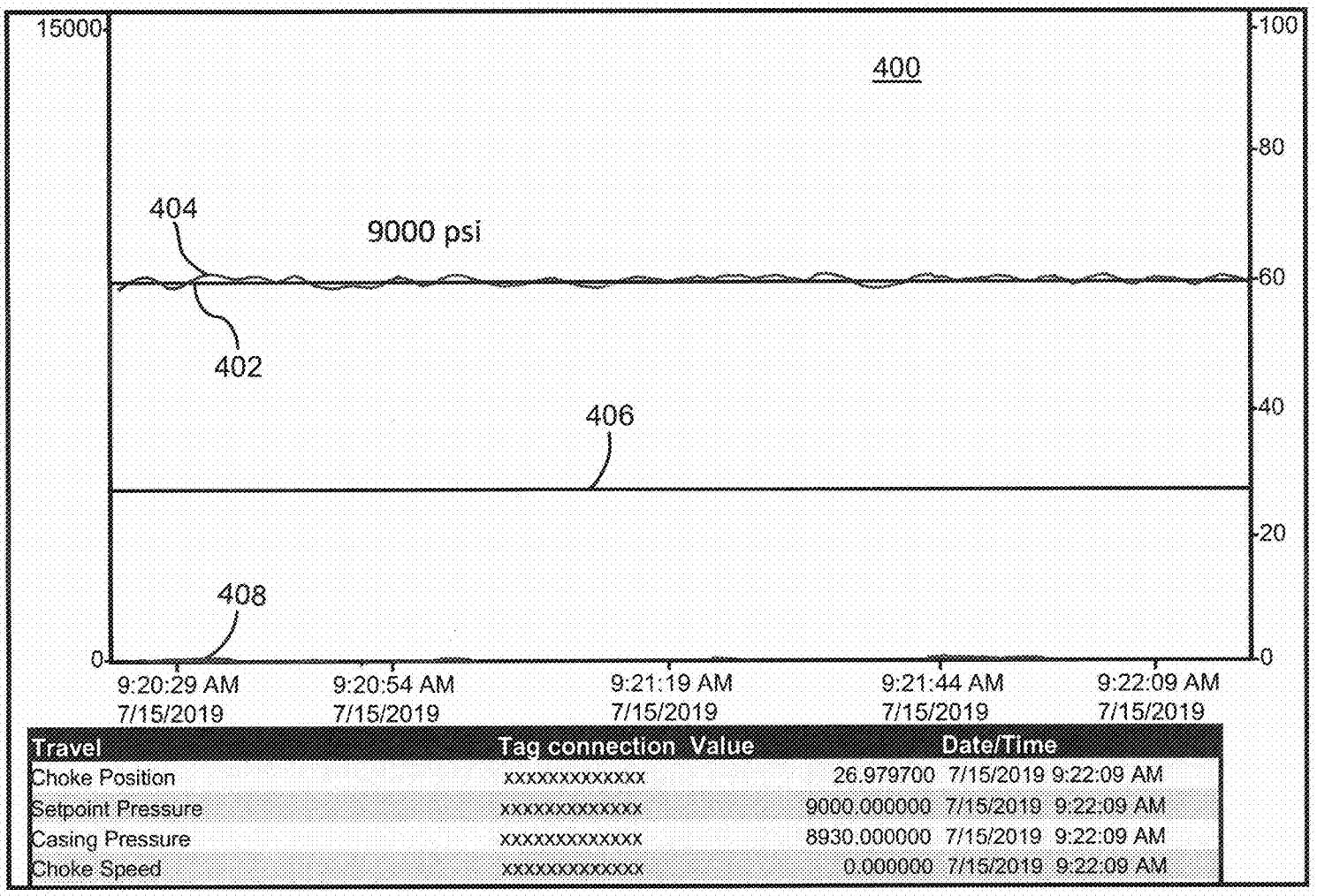
FIG. 4 shows a printed result of another test conducted by an automated high-pressure pump testing system in accordance with yet another embodiment, in this case a 9000 psi auto pressure hold test.

FIG. 4 shows a printed result 400 of another high-pressure pump test conducted by an automated high-pressure pump testing system in accordance with yet another embodiment, in this case a 9000 psi auto pressure hold test. Thus, this test included only one test phase. In the report 400, the pressure setpoint commanded by the automated testing system 100 (i.e., the predetermined pressure) is shown by line 402 and the actual pressure measured by the system (e.g., by the pressure sensor 113) is shown by line 404. The associated actuator movement measured by the system 100 (e.g., by the actuator drive 108) is shown by line 406. The associated actuator speed is shown by line 408.

During the testing of high-pressure pumps, especially during acceptance testing after pump maintenance, there can sometimes be a failure of a newly replaced part and/or the dislodgment of tools, broken parts or other debris left within the pump during maintenance. As the pump testing proceeds, such debris can move through the pump 102 and into the choke 104, where they can become jammed in the throat of the choke. Therefore, in some embodiments of the system 100, the stored instructions in the system memory of the system control unit 110 can comprise an algorithm that detects the presence of debris in the choke 104 during testing. In one such embodiment, the stored instructions in the system memory of the system control unit 110 can comprise an algorithm that detects when choke gate movement has stopped or been impeded when trying to travel to higher pressure set point (i.e., when closing the gate). For example, the detection algorithm in the system control unit 110 can monitor the choke position signals 142 and/or the choke actuator speed signals 144 while the actuator 106 is commanded to move the choke gate to achieve to a new setpoint or predetermined pressure. If the detection algorithm in the system control unit 110 detects that the actuator 106 has stopped moving or the actuator speed as measured by signal 144 is unexpectedly low before the new predetermined pressure is attained, the algorithm can cause the system control unit to stop any further movement of the choke gate and can send out an error message to the display device on the system control unit, the operator station 126 and/or the mobile statin 130 for a user to perform an inspection or maintenance on the choke valve 104.

It will be appreciated by those skilled in the art having the benefit of this disclosure that this automated high-pressure pump testing system provides many advantages in safety, speed and convenience compared to previous procedures for testing high-pressure pumps. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A system for automated testing of a high-pressure pump, the high-pressure pump having a pump outlet line for carrying high-pressure fluid, the system comprising:

a choke valve defining a choke passage therethrough having an inlet at one end, an outlet at the other end and a gate positioned therebetween, wherein the gate is selectively movable along a path to change a fluid restriction value of the choke passage;

wherein the inlet of the choke is connectable to a pump outlet line of a high-pressure pump to be tested;

a choke actuator having an input shaft and operatively connected to the gate of the choke valve for moving the gate along the path in response to rotation of the input shaft;

an actuator drive operatively connected to the input shaft of the actuator for selectively rotating the input shaft in response to receiving actuator drive control signals;

a system control unit including:

a processor unit for executing program steps;

a system memory for storing program steps and data;

an input/output (I/O) interface for communicating between the processor unit and system memory;

a human-machine interface (HMI) for accepting control inputs from a human user; and a display device for communicating at least one of a system status and a test result to the human user;

a pressure sensor connected to the pump outlet line for sensing the pressure of a fluid in the pump outlet line and communicating pump output pressure signals indicative of the fluid pressure within the pump outlet line to the system control unit; and wherein the system control unit can execute a first test phase by:

causing the pump to run at a first speed and causing the actuator drive to rotate the input shaft of the actuator to cause the actuator to move the gate of the choke valve to change the fluid restriction value of the choke passage until a first predetermined pressure is sensed in the pump outlet line by the pressure sensor and reported to the system control unit via the pump output pressure signals;

causing the actuator drive to rotate the input shaft of the actuator to cause the actuator to move the gate of the choke valve to change the fluid restriction of the choke passage to maintain the first predetermined pressure for a first predetermined period of time; and causing the display device to show a result of the first test phase or print a report showing the result of the first test phase.

2. The system for automated testing of claim 1, further comprising:

wherein after executing the first test phase, the system control unit can execute a subsequent test phase by:

causing the pump to run at a subsequent speed and causing the actuator drive to rotate the input shaft of the actuator to cause the actuator to move the gate of the choke valve to change the fluid restriction value of the choke passage until a subsequent predetermined pressure is sensed in the pump outlet line by the pressure sensor and reported to the system control unit via the pump output pressure signals;

wherein the subsequent predetermined pressure is higher than the first predetermined pressure;

causing the actuator drive to rotate the input shaft of the actuator to cause the actuator to move the gate of the choke valve to change the fluid restriction of the choke passage to maintain the subsequent predetermined pressure for a subsequent predetermined period of time; and causing the display device to show a result of the subsequent test phase or print a report showing the result of the subsequent test phase.

3. The system for automated testing of claim 1, wherein stored instructions in the system memory are executed by the system control unit to cause:

while the actuator is commanded to move the gate of the choke valve to achieve to a new predetermined pressure, the system control unit monitors at least one of a choke position signal and a choke actuator speed signal; and when the system control unit detects, before the new predetermined pressure is attained, that either the monitored choke position signal has stopped changing or the monitored choke actuator speed signal is unexpectedly low, the system control unit:

stops any further movement of the gate of the choke valve; and sends out an error message to the display device; and whereby debris in the choke passage are detected during a test.

4. The system for automated testing of claim 2, further comprising:

wherein after executing the subsequent test phase, the system control unit can execute at least one respective successive test phase by:

causing the pump to run at a respective successive speed and causing the actuator drive to rotate the input shaft of the actuator to cause the actuator to move the gate of the choke valve to change the fluid restriction value of the choke passage until a respective successive predetermined pressure is sensed in the pump outlet line by the pressure sensor and reported to the system control unit via the pump output pressure signals;

wherein the respective successive predetermined pressure is higher than the subsequent predetermined pressure;

causing the actuator drive to rotate the input shaft of the actuator to cause the actuator to move the gate of the choke valve to change the fluid restriction of the choke passage to maintain the respective successive predetermined pressure for a respective successive predetermined period of time; and causing the display device to show a result of the respective successive test phase or print a report showing the result of the subsequent test phase.

5. The system for automated testing of claim 4, wherein for each further respective successive test phase, the further respective successive predetermined pressure is a higher pressure than the previous respective successive predetermined pressure until a maximum pressure required for acceptance of the high-pressure pump is successfully achieved.

6. The system for automated testing of claim 1, further comprising:

a low-pressure fluid line fluidly connected at a first end to the outlet of the choke valve;

a fluid storage tank having a tank inlet fluidly connected to a second end of the low-pressure fluid line; and a fluid intake line fluidly connected at a first end to a tank outlet of the fluid storage tank and fluidly connected at a second end to an intake of the high-pressure pump to be tested; and whereby a test fluid can be recirculated through the fluid storage tank, the high-pressure pump and the choke valve during testing.

7. The system for automated testing of claim 6, further comprising:

a chiller unit operably connected to the fluid storage tank; and wherein operation of the chiller unit removes heat from the test fluid as the test fluid is recirculated through the fluid storage tank, the high-pressure pump and the choke valve during testing.

8. The system for automated testing of claim 1, further comprising:

an operator station operably connected to the system control unit with remote control lines, the operator station including:

the human-machine interface (HMI) accepting control inputs from a human user; and the display device communicating system status and results to the human user.

9. The system for automated testing of claim 8, wherein the operator station is operably connected to the system control unit when disposed at a human-safe distance from the high-pressure pump to be tested.

* * * * *